United States Patent [19]

Daniels

[11] Patent Number: 4,525,957

[45] Date of Patent: Jul. 2, 1985

[54] APPARATUS AND METHOD FOR FINISHING RADIAL COMMUTATOR

[75] Inventor: Robert L. Daniels, W. Newton, Mass.

[73] Assignee: Ex-Cell-O Corporation, Troy, Mich.

[21] Appl. No.: 590,242

[22] Filed: Mar. 16, 1984

[51] Int. Cl.[3] ..... B24B 19/00

[52] U.S. Cl. ..... 51/244; 51/281 SF; 51/131.1

[58] Field of Search ..... 51/244, 241 R, 281 R, 51/281 SF, 241 R, 118, 119, 131.4, 132, 133

[56] References Cited

U.S. PATENT DOCUMENTS 325,296 9/1885 Wetherbee ..... 51/209 R 969,633 9/1910 Jordan ..... 51/244

3,965,623 6/1976 Grutza et al. ..... 51/244

FOREIGN PATENT DOCUMENTS 159431 10/1962 U.S.S.R. ..... 51/133

*Primary Examiner*—Roscoe V. Parker

*Attorney, Agent, or Firm*—John C. Evans

[57] ABSTRACT

Grinding apparatus and a method for finishing face-type commutator are shown for producing a cycloidal like grinding pattern which has a controlled depth of surface roughness established by the grain size of abrasive grit and a pitch which is controlled by relative rotational speeds of the tool and the workpiece.

4 Claims, 8 Drawing Figures

FIG.7
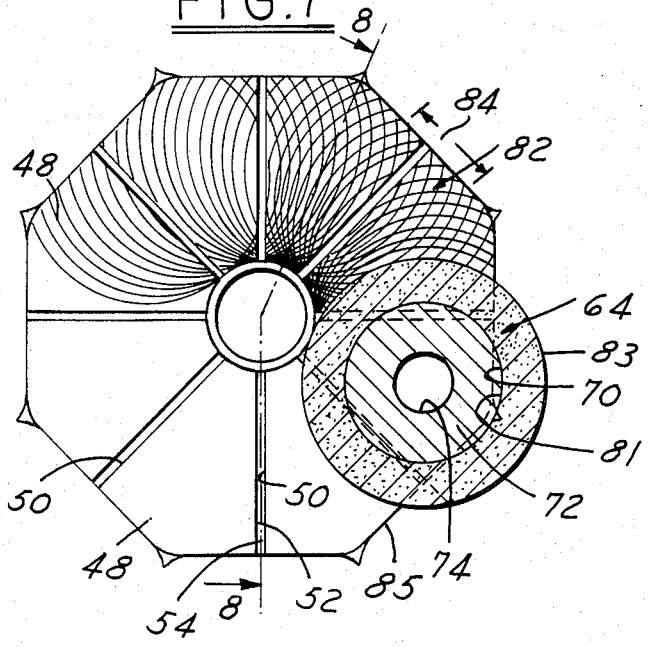
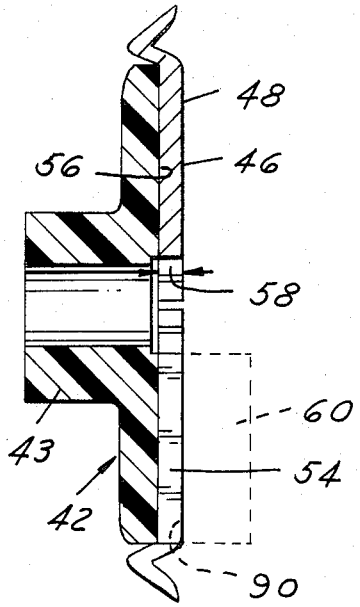
FIG.8

APPARATUS AND METHOD FOR FINISHING RADIAL COMMUTATOR

FIELD OF THE INVENTION

This invention relates to a method and apparatus for practicing a method for finishing face type commutators and more particularly to grinding methods and apparatus for such finishing.

BACKGROUND OF THE INVENTION

Face-type commutators for electric motors have a plurality of electrically conductive bars pre-assembled on a commutator body. In some motor applications the commutators are immersed in dielectric fluids but are not limited to use in such applications.

In the past, diamond cutting tools have been used to finish flat face surfaces of such commutators to remove bar-to-bar dimensional irregularities to produce a uniform commutator surface.

Brush commutated electric motors which operate in dielectric fluids or the hard vacuum of outer space have very special problems related to the mating of contacting brush surface and commutator. These conditions require the use of an especially soft brush material which if not properly mated to the commutator will glaze and not carry the electrical current necessary for the motor to do its job. An improperly seated brush will have areas which carry too much current, which causes arcing and consequent pitting of the commutator, leading to early motor failure.

The prior finishing methods including use of diamond cutting tools can produce a surface roughness on the surface and edge burr condition that can increase motor brush run-in time and which may or may not achieve proper mating of the brush and commutator.

Prior art apparatus for grinding commutator surfaces to finish conductor segments of cylindrical type commutators is shown in U.S. Pat. Nos. 969,633 and 3,965,623. Such apparatus expose only a limited portion of the commutator bars to a limited peripheral edge of a grinder wheel and the grinding wheel is advanced along the depth of the commutator bars so as to minimize burr formation and as such does not solve the problem of burr formation at the break line between conductor bars arranged in a flat surface radial disposition.

SUMMARY OF THE INVENTION

The subject invention provides an improved method and apparatus for uniformly finishing pre-assembled commutator bar segments to remove dimensional variations therebetween by a repetitive sweeping grinding pattern that produces a brush path finish on the commutator which has uniformity, axial run-out held to tolerances measured in tenths of one-thousandths of an inch. The tool marks which characterize the finish produced by the process are on the order of from twenty to sixty micro inches in depth. This roughness is necessary to actually machine the contacting brush surface so that its entire surface contacts the commutator, but is fine enough so that at the time that the brush is machined to mate with the commutator, the surface of the commutator has been electrolytically etched to a smooth mating with the brush. This is accomplished in a few seconds. The described invention allows the surface roughness to be controlled in such a manner as to be varied to have a greater or lesser aggressiveness in machining of the brush to accommodate harder or softer brush materials. Improper seating of brush to commutator is evidenced by early failure of the motor; usually the complete electrolytic etching away of the current carrying commutator conductors. In order to accomplish such motor brush run-in and to conform brush contact surfaces to the flat mating surface of the commutator, a flat abrasive surface is rotated on a first axis and the commutator is rotated on a second axis, parallel to and offset from the first axis so that the abrasive surface is relatively positioned with respect to the pre-assembled bar segments to produce a repetitive cycloidal like grinding pattern in the commutator brush surface of the desired controlled roughness while correcting dimensional variations in its pre-assembled component parts.

Another aspect of the present invention is to provide an improved finishing machine which includes a rotating spindle with a workpiece holding device that locks the body of a commutator assembly to the spindle, aligns the longitudinal axis of the body with the axis of rotation of the spindle and which positions a flat face on the commutator in a plane perpendicular to such axis; and further includes a tool slide and rotating grinder head spindle having an abrasive tool holder and a cylindrical abrasive tool with a flat end face selectively engageable with the flat commutator face to finish the surface and remove dimensional irregularities from component parts thereof; the flat end face of the abrasive tool having a diameter equal to or greater than the height of individual bar segments of the commutator and rotating on an axis offset from the axis of rotation of the rotating workpiece spindle so as to produce a pattern of sweeping grind marks across the flat face of the commutator that uniformly abrades the commutator brush surface to a controlled surface roughness to enhance brush contact conformation thereto and finish the brushes' contacting surfaces more rapidly than by known cylindrical grinding methods or prior normal surface grinding techniques where a dresser is traversed across the commutator's face.

PRIOR ART STATEMENT

Cylindrical grinding methods of U.S. Pat. Nos. 969,633 and 3,965,623 disclose use of grinders to finish the surface of axial surfaces on individual commutator bars located at circumferentially spaced points on a ring type cylindrical motor commutator. There is no suggestion of apparatus or a method for uniformly abrading to a precisely controlled roughness over the full planar extent of a flat face type commutator. Further, there is no suggestion of an apparatus that rotates a flat surface of a face type commutator on a first axis and which rotates a flat end of an abrasive tool on a second axis parallel to the first axis so as to produce an cycloidal like grinding pattern that uniformly removes dimensional irregularities which produce controlled surface roughness in a plurality of pre-assembled conductor segments in a flat type commutator.

U.S. Pat. No. 325,296 discloses a machine with a workholder spindle and a cutting tool with an axis offset from the axis of dish f; the tool being operative to form a recess in the face of the dish f. The '296 patent does not suggest a grinder apparatus with a toolholder that rotates the workpiece on one axis and a grinder with a flat end face also rotated against pre-assembled conductor segments of a flat type commutator assembly to uniformly correct dimensional irregularities across all of the conductor segments.

BRIEF DESCRIPTION OF THE DRAWINGS

Other advantages of the present invention will be readily appreciated as the same become better understood by reference to the following detailed description when considered in connection with the accompanying drawings wherein:

FIG. 7 is an end view of a commutator showing the tool mark pattern produced by use of the apparatus and method of the present invention; and FIG. 8 is a fragmentary sectional view taken along line 8—8 of FIG. 7.

DESCRIPTION OF PREFERRED EMBODIMENT

Figure 1:
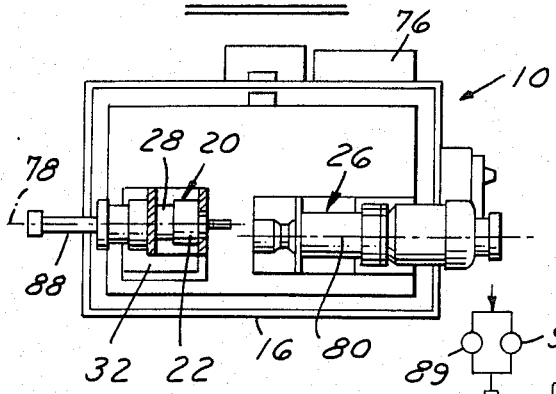
FIG. 1 is a top elevational view of a preferred embodiment of an apparatus constructed in accordance with the present invention.
Figure 2:
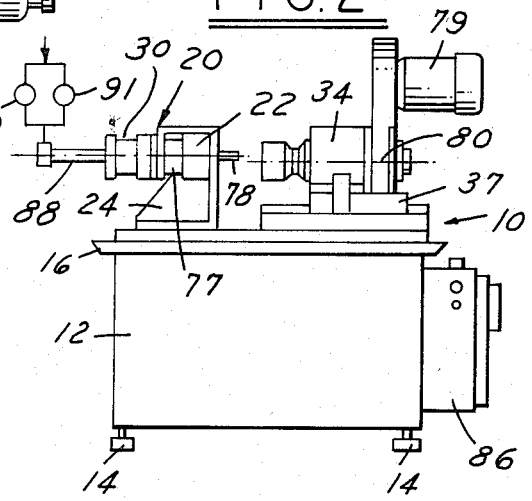
FIG. 2 is a front elevational view of the apparatus of FIG. 1.

FIGS. 1 and 2 show a machine assembly generally indicated at 10 and constructed in accordance with the present invention. The machine assembly 10 includes a base 12 with an adjustable vibration damping support pad 14 at each of its corners. A coolant trough 16 surrounds the top surface 18 of the base 12.

A grinder head 20 has a motor driven spindle 22 supported on an axially movable support 24 which is advanced and retracted with respect to a workpiece support 26 on a slide 28 by means of a pneumatic drive cylinder 30 which is controlled to limit the pressure of the tool acting on the workpiece.

The grinder head 20 has a manually adjustable cross-feed plate 32.

The workpiece support 26 includes a motor driven spindle 34 with an air chuck 36. The spindle 34 is mounted on a six-inch stroke headstock slide 37. The air chuck 36 has fingers 38 that will securely lock a motor rotor workpiece 40 on the spindle 34 and a workpiece stop to axially locate the workpiece accurately.

Figure 3:
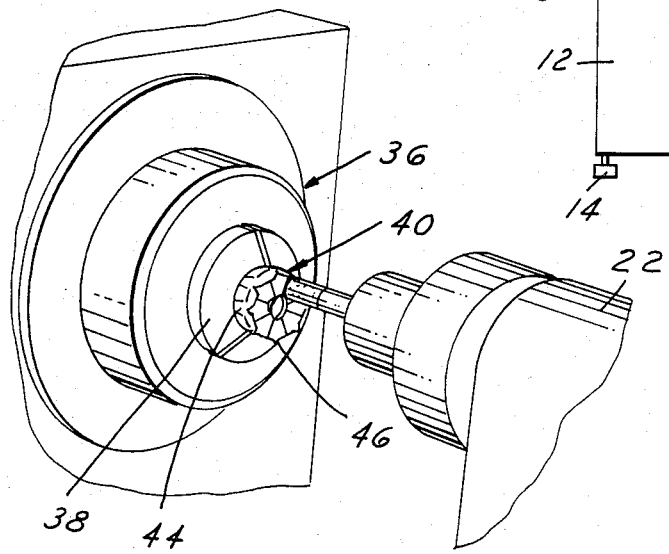
FIG. 3 is a fragmentary, perspective view of the workholder chuck with an associated flat face type commutator supported in grinding relationship with the abrasive tool and drive head.

As best shown in FIGS. 3 and 8 the motor rotor 40 includes a body 42 with an end 43 held by the fingers 38; a motor winding 44 and a flat face type commutator surface 46 made up of a plurality of circumferentially located and spaced conductor segments or bars 48 each having a progressively greater width from the I.D. to the O.D. of the commutator.

The plurality of conductor segments or bars 48 each with a pair of side edges 50, 52 on either side of a slot 54 which electrically insulates the segments 48 from each other. Each segment 48 is pre-assembled with respect to a reference surface 56 of the body 42.

Before the pre-assembled parts are finished, irregularities in the dimensions of the individual conductor segments 48 in the assembled (and unfinished) workpiece 40 can have unevenness at the edges 50, 52 between adjacent conductor segments 48 and variations in thickness 58.

In accordance with the present invention the full planar extent of the surface 46 is processed to remove such irregularities while producing a smooth surface roughness on the flat face to reduce the time required to run in the commutator engaging surfaces of motor brushes 60, one shown by dotted lines in FIG. 8.

Figure 5:
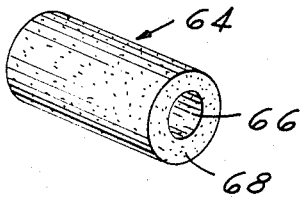
FIG. 5 is a perspective view of an abrasive cylinder of the tool of FIG. 4.
Figure 4:
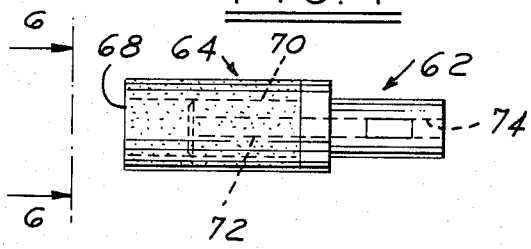
FIG. 4 is a side elevational view of the assembled abrasive tool of FIG. 3.
Figure 6:
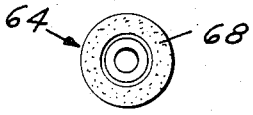
FIG. 6 is an end elevational view of the abrasive cylinder of FIG. 5.

The tool 62 of FIGS. 4–6 includes a hollow cylinder 64 with a suitable abrasive grit of carbide or other fine grit abrasive bonded by a material of suitable strength to support loads imposed during machining of the segments 48. The cylinder 64 has a central bore 66 and a ring configured flat end hone surface 68 with abrasive grains sized to establish the depth of wear pattern on the commutator segments 48 to smooth the full planar extent of the segments defining surface 46. The tool cylinder 68 is mounted by a suitable adhesive layer 70 to a tubular steel shank 72 mounted to spindle 22. A coolant-/lubricant passage 74 is supplied from a coolant pump and reservoir 76 for discharge to trough 16.

The inventive method of the present invention produces a desired surface geometry and finish to assure rapid break-in of brushes for radial or face type commutators includes the following method steps.

The spindle and mounted tool 62 are rotated by a variable speed motor 77 on a first axis 78. The workpiece 40 is rotated by a variable speed motor 79 on a spindle drive axis of rotation 80 offset from axis 78 and parallel thereto. The outside diameter of end surface 68 is thus positioned to cover the full planar extent of the surface 46. Also, in the preferred embodiment the inner and outer edges 81 and 83 of the annulus of hollow cylinder 64 clear the outer edge 85 of the rotor 40 as shown in FIG. 7.

The workpiece 40 is rotated with respect to the rotating abrasive end surface 68 to produce a plane surface with a series of cycloidal like tool marks 82 whose depth is controlled by the grain size of the abrasive grit and whose pitch 84 is determined by the relative rotational speed of the tool 62 and workpiece 40. Reversing the rotation and/velocity of the hone cylinder 64 with relation to the commutator can produce a change in the pattern shown in FIG. 7. At equal and opposite speeds the pattern appears as nearly straight radial lines.

The drive speed of the workpiece 40 on axis 80 and the second drive speed of the tool 62 on offset axis 78 are controlled by a pre-programmable digital type controller 86 which can be preset to vary rotational speed of the workpiece and the tool so as to control the surface roughness and machining time. The selection of abrasive grit size, rotational speed of the workpiece 40 and the rotational speed of and the tool 62 and control of direction and time of rotation can be combined in various combinations to produce controlled surface roughnesses. In the illustrated machine 10 the grinder head motor 77 can be controlled in a range of 200 to 3000 rpm and the workpiece motor 79 can be controlled in a range of 200 to 3500 rpm. Tool spindle and work spindle are both belt driven at one ratio. Both drive motors are adjustable speed motors.

In another aspect of the present control is that the pneumatic drive cylinder 30 is associated with a suitable pressure regulator 88 that will control the face pressure between the end hone surface 68. In the preferred form, a small air cylinder fed by two pressure regulators 89, 91. Regulator 89 furnishes a higher pressure to produce the hone cutting action. Regulator 91 furnishes a lower pressure to finish surface effects resulting during the higher pressure phase. The combination of speed, grit and pressure variables produces a surface roughness on the full planar extent of the face of a flat type commutator that will run-in the brush contact surfaces for proper electrical contact (uniform geometry) in a finally assembled and finished motor while simultaneously producing mating surfaces for improved brush wear during operation of the motor assembly.

By virtue of the present invention the finish is uniform and axial runout is held to tolerances measured in tenths of one thousandths of an inch. The tool marks which characterize the finish produced by this process are of a uniform depth on the order of from twenty to sixty micro inches (millionths of an inch). This roughness is necessary to actually machine the contacting brush surface 90 so that its entire surface contacts the commutator surface 46 but is fine enough so that at the time that the brush is machined to mate with the commutator, the surface 46 of the commutator is electrolytically etched to a smooth mating with surface roughness to be controlled in such a manner as to be varied to have a greater or lesser aggressiveness in machining of the brush to accommodate harder or softer brush materials.

The invention has been described in an illustrative manner, and it is understood that the terminology which has been used is intended to be in the nature of words of description rather than limitation.

Obviously, many modifications and variations of the present invention are possible in light of the above teachings. It is to be understood that within the scope of the appended claims, the invention may be practiced otherwise than is specifically described.

The embodiments of the invention in which an exclusive property or privilege is claimed are defined as follows:

1. Apparatus for grinding a face type commutator having a plurality of soft metal electrically conductive commutator segments with radially extending faces each of the segments being separated by slots comprising, rotatable drive spindle means for mounting the commutator to locate the radially extending faces thereon in a first plane perpendicular to a first axis of rotation of said drive spindle means;

a rotatable grinder head means and an abrasive cylinder rotatably driven by said grinder head means on a second axis of rotation offset from said first axis of rotation;

said abrasive cylinder having a flat end positioned by said grinder head means in a plane perpendicular to both of said first and second axes and parallel to said first plane;

means for concurrently rotating the commutator and the abrasive cylinder on said first and second axes of rotation;

and pressure limiting means for controlling abrasion between the flat end of said abrasive cylinder and the flat faces of the commutator assembly to produce a cycloidal tool mark pattern with a uniform surface roughness through the full planar extent of the commutator face.

2. In the combination of claim 1, said rotatable drive spindle means including a first variable speed drive, motor, said rotatable grinder head means including a second variable speed motor, and control means to vary the relative speed of said first and second variable speed motors to control the pitch of the tool mark pattern.

3. A process for grinding the full radial surface of a face type commutator to produce a uniform tool mark pattern across pre-assembled electrically conductive commutator segments adapted to be engageable with motor brush means comprising the steps of:

rotating the radial surface of the commutator at a first speed on the longitudinal axis of the commutator;

rotating a flat abrasive surface with a diameter substantially equal to the radial surface on an axis offset from the axis of rotation of the commutator;

relatively pressuring the rotating radial surface against the rotating flat abrasive surface to produce cycloidal tool marks across the full planar extent of the radial surface so as to uniformly remove irregularities in the surface dimensions of the pre-assembled commutator segments while producing a controlled surface roughness across the full planar extent of said segments.

4. In the combination of claim 3; including the additional steps of pre-selecting the relative speed of rotation of the commutator and the flat abrasive surface to control the pitch of the tool marks on the commutator.

* * * * *